US006609856B1

(12) United States Patent
Knight

(10) Patent No.: US 6,609,856 B1
(45) **Date of Patent: *Aug. 26, 2003**

(54) PROCESS OF INSTALLING A PRECAST CONCRETE PILE BELOW A STRUCTURE

(76) Inventor: David W. Knight, P.O. Box 2586, Humble, TX (US) 77347

( * ) Notice: Subject to any disclaimer, the term of this patent is extended or adjusted under 35 U.S.C. 154(b) by 0 days.

This patent is subject to a terminal disclaimer.

(21) Appl. No.: 09/545,144

(22) Filed: Apr. 7, 2000

(51) Int. Cl.[7] ..... E02D 5/30

(52) U.S. Cl. ..... 405/230; 405/232; 405/251

(58) Field of Search ..... 405/230, 229, 405/231, 232, 233, 244, 245, 249, 251, 255, 256; 52/170, 515, 721.1, 721.4, 722.1, 723.2, 742.1, 742.14

(56) References Cited

U.S. PATENT DOCUMENTS

| | | | | |
|---|---|---|---|---|
| 1,079,375 A | * | 11/1913 | Stange | 405/252 |
| 2,881,613 A | * | 4/1959 | Taylor et al. | 52/479 |
| 3,199,300 A | * | 8/1965 | Fiore | 405/251 |
| 3,292,331 A | * | 12/1966 | Sams | 52/405.2 |
| 3,326,006 A | | 6/1967 | Mount | |
| 3,487,646 A | | 1/1970 | Gatien | |
| 3,555,833 A | | 1/1971 | Correa | |
| 3,630,037 A | | 12/1971 | Howard | |
| 3,703,812 A | | 11/1972 | Newton | |
| 3,780,484 A | * | 12/1973 | Muse | 52/585.1 |
| 3,851,483 A | | 12/1974 | Holley, Jr. | |
| 3,899,891 A | * | 8/1975 | Kelly et al. | 405/251 |
| 4,190,383 A | * | 2/1980 | Pryke et al. | 405/252 |
| 4,452,028 A | * | 6/1984 | Norton et al. | 52/742.14 |
| 4,525,102 A | * | 6/1985 | Gillen | 405/232 |
| 4,678,373 A | * | 7/1987 | Langenbach, Jr. | 405/230 |
| 4,838,737 A | | 6/1989 | Quimby | |
| 4,915,544 A | | 4/1990 | Lin | |
| 5,108,227 A | | 4/1992 | Bergey | |
| 5,217,326 A | * | 6/1993 | Bullivant | 405/233 |
| 5,228,807 A | | 7/1993 | Willcox, Jr. | |
| 5,288,175 A | | 2/1994 | Knight | |
| 5,320,453 A | * | 6/1994 | Bullivant | 405/256 X |
| 5,399,055 A | * | 3/1995 | Dutton, Jr. | 405/230 |
| 5,669,736 A | | 9/1997 | Lin | |
| 5,713,701 A | | 2/1998 | Marshall | |
| 5,788,419 A | * | 8/1998 | Whitty, Jr. et al. | 405/256 |
| 6,061,986 A | * | 5/2000 | Canada | 52/561 |
| 6,179,526 B1 | * | 1/2001 | Knight | 405/232 |
| 6,200,070 B1 | * | 3/2001 | Knight | 405/232 |

FOREIGN PATENT DOCUMENTS

| | | | | |
|---|---|---|---|---|
| GB | 2047303 | * | 11/1980 | 405/230 |

* cited by examiner

*Primary Examiner*—Heather Shackelford
*Assistant Examiner*—Jong-Suk Lee
(74) *Attorney, Agent, or Firm*—Harrison & Egbert

(57) ABSTRACT

A process for installing piles for supporting a structure upon the earth including the steps of driving a first pile segment into the earth a desired distance from the structure, aligning a second pile segment upon the first pile segment such that a conduit in the second pile segment is axially aligned with the conduit of the first pile segment, driving the first and second pile segments into the earth a desired distance from the structure, affixing a strand into the conduits of the first and second pile segments so as to form a starter section, and sliding another pile segment along the strand so as to reside upon the starter section. A plurality of pile segments are positioned along the strand so as to reside in stacked relationship upon the starter section. A cap member is positioned between a portion of the structure at an uppermost pile segment of the plurality of pile segments. An end of the strand is anchored in the cap member.

18 Claims, 7 Drawing Sheets

PROCESS OF INSTALLING A PRECAST CONCRETE PILE BELOW A STRUCTURE

TECHNICAL FIELD

The invention relates to the repair of building foundations by underpinning. More specifically, it relates to a method for aligning pile segments during installation and continuously reinforcing an improved segmental precast concrete pile used for underpinning repairs.

BACKGROUND ART

There is a type of precast concrete pile used in the underpinning of building foundations comprised of vertically stacked, unconnected, precast concrete segments. These segments are pressed or driven vertically into the soil one at a time until adequate load capacity is obtained. This type of pile is distinctive in that it can be installed with almost no clearance, usually beneath an existing structure.

Although serviceable, this pile has several significant disadvantages: (a) the pile segments are not aligned, other than being stacked on each other, and detrimental misalignments can occur, (b) independent inspection of the installed pile depth is only possible by providing full-time inspection personnel during installation to monitor the quantity of pile segments used at each pile location, and (c) the complete pile is an unreinforced stack of precast concrete segments.

Misalignment of the segments as they are installed can produce several conditions detrimental to the future pile stability. Lack of proper independent inspection of pile depth can lead to inadequate pile penetration, which in highly expansive soils produces an unstable installation subject to continued movements caused by seasonal change in soil moisture. An unreinforced or non-continuously reinforced pile is subject to permanent separation at segment joints or breakage at segment midpoints when installed in clay soils having high shrink-swell potentials.

This separation of segments occurs when clay soils swell due to an increase in moisture content. This soil expansion exposes the pile to tension forces. This is especially detrimental to an unreinforced pile because even slight soil intrusion into the gaps between segments prevents closing of the gaps when soil moisture decreases. Over a period of years, this cyclical shrink-swell effect can lift the upper portion of the pile and the unsupported structure. This lifting effect at pile support locations falsely appears as settlement of adjacent unsupported areas.

Various patents have issued on the process relating to the installation of underpinning piles below a structure. U.S. Pat. No. 5,288,175, issued on Feb. 22, 1994, to D. W. Knight, teaches a segmental precast concrete underpinning pile which uses a method of installation where a high strength strand aligns the precast segments during installation and continuously reinforces the pile when bonded or anchored upon completion. The process of this patent includes the driving of a first pile segment into the earth a desired distance from the structure, sliding a second pile segment on the strand until the second pile segment contacts an end of the first pile segment, and driving the second pile segment another desired distance into the earth. In this patent, the first pile segment has an end of the strand fixedly received therein. As the first pile segment is being driven into the earth, the strand will follow the first pile segment and extend outwardly therefrom. The second pile segment is then placed over the strand and driven along the strand until it comes into contact with the first pile segment.

U.S. Pat. No. 5,399,055, issued on Mar. 25, 1995, to E. T. Dutton, Jr. teaches a device and method to level and repair a failed concrete foundation. In this process, a series of cylindrical pile segments are jacked into the soil. Reinforcing steel is inserted into the fully installed stacked column of cylindrical pile segments and group is further pumped into the cylindrical pile segments to suitably fix the reinforcing steel to the inside of the cylindrical pile segments. Thisforms a single shaft pile.

In these two types of pile systems, one utilizes a strand upon which segments are threaded, and the other requires the strand to be threaded into an installed stack of segments. The second method requires that the central conduit in the segment be rather large with respect to the cable. Even so, when a reinforcing strand is threaded into a pre-installed stack of blocks, there is no mechanism for aligning the blocks prior to installing the reinforcing strand. This method allows significant misalignments of the pile, such that in many cases the reinforcing strand is unable to travel the full depth of the pile. The resultant pile is deficient due to both the misalignment and the lack of full depth reinforcement. When such deficiencies exist, it would be necessary to start the process over again and reinstall the pile. As such, need has developed so as to assure the proper alignment between the pile segments during actual installation and provide continuous, full-depth reinforcement.

A problem with the process of U.S. Pat. No. 5,288,175 is that the end of the strand is anchored into a relatively small single pile segment prior to installation below the structure. Because of fabrication and handling costs, and because of the small amount of clearance between the structure and the earth, it is only possible to anchor the strand into a pile segment having a relatively small size. It is not feasible to use larger starter segments because of this small amount of clearance. If a greater clearance was made, then it would be possible to form a starter segment having a greater length and to transport such a large starter segment to the area beneath the structure. However, the weight of such an enlarged starter segment would make fabrication, transport and installation very difficult and costly. Mechanical devices would be required to properly transport the starter segment to the area. A starter segment having a length significantly greater than twelve inches would greatly increase the weight of the starter segment. The existing use of a single starter segment limits the strand anchoring capacity. As such, failure of the anchorage is possible. Also, this limited anchorage capacity may be inadequate for tensioning the strand upon completion. As such, with this prior art system of installing pile segments, buckling of the stacked pile segments is possible.

It is an object of the present invention to provide a process for installing pile segments which better resists misalignment of pile segments with respect to each other.

It is another object of the present invention to provide a process of installing piles which avoids the cost of manufacturing larger starter segments.

It is another object of the present invention to provide a process of installing piles which eliminates the difficulty of handling larger starter segments.

It is a further object of the present invention to provide a process of installing piles which provides greater strand anchorage capacity within the starter section.

It is still a further object of the present invention to provide a process for installing pile segments which is easy to use and relatively inexpensive.

These and other objects and advantages of the present invention will become apparent from a reading of the attached specification and appended claims.

SUMMARY OF THE INVENTION

The present invention is a process for installing piles for supporting a structure upon the earth comprising the steps of: (1) driving a first pile segment into the earth a desired distance from the structure; (2) aligning a second pile segment upon the first pile segment such that a conduit in the second pile segment is axially aligned with a conduit of the first pile segment; (3) driving the first and second pile segments into the earth a desired distance from the structure; (4) affixing a strand into the conduits of the first and second pile segments so as to form a starter section; (5) sliding another pile segment along the strand so as to reside upon said starter section; and (6) driving the starter section and subsequent pile segments a desired distance from the structure.

The process of the present invention can further include the step of aligning a third pile segment upon the second pile segment such that the conduit of the third pile segment is axially aligned with the conduits of the first and second pile segments. The first, second and third pile segments are then driven into the earth a desired distance from the structure. The conduits of the first, second and third pile segments are holes which extend vertically through their respective segments.

In the process of the preferred embodiment of the present invention, the first pile segment is driven a desired distance into the earth from the structure. An alignment pin is then applied into the first pile segment such that a portion of the alignment pin extends outwardly of the top of the first pile segment. A second pile segment is then placed over the alignment pin such that a portion of the alignment pin extends outwardly of the top of the second pile segment. This allows the conduit of the second pile segment to be aligned with the conduit of the first pile segment. The alignment pin is then removed from the first and second pile segments. A strand is then affixed within the conduits of the first and second pile segments.

Alternatively, the step of aligning includes installing a tubular member into the conduit of the first pile segment such that a portion of the tubular member extends outwardly of a top of the first pile segment and then placing the conduit of the second pile segment over the tubular member.

Alternatively, the step of aligning includes the steps of installing a ring around an outer surface of the first pile segment so as to have a portion extending above a top of the first pile segment and placing the first pile segment into the ring such that a second pile segment is received in that portion of the ring. The step of affixing the strand includes bonding the strand within the conduits of the first and second pile segments. Specifically, a cementing material is injected into a space between the outer surface of the strand and a wall of the conduits of the first and second pile segments.

In the preferred method of the present invention, the step of sliding another pile segment includes sliding a plurality of pile segments along the strand so as to reside in stacked relationship upon the starter section. The strand extends through aligned conduits formed in the plurality of pile segments. A cap member is positioned between a portion of the structure and an uppermost pile segment of the plurality of pile segments. An end of the strand is anchored in the cap member.

The method of the present invention can also include removing a volume of earth from beneath a portion of the structure and then positioning the first pile segment directly below that portion of the structure.

DETAILED DESCRIPTION OF THE INVENTION

Figure 1:
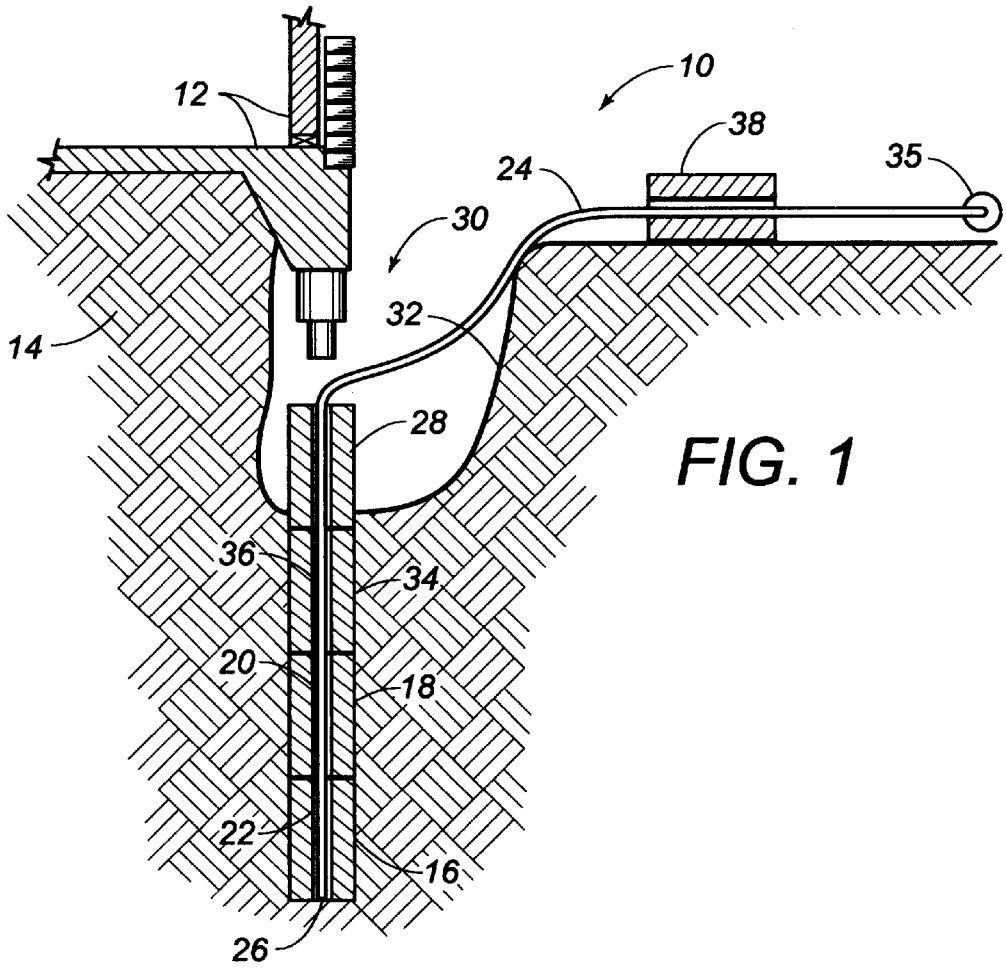
FIG. 1 is a diagrammatic illustration of the installation method in accordance with the teachings of the present invention.

Referring to FIG. 1, there is shown the precast concrete pile 10 for the installation of pile segments for supporting a structure 12 upon the earth 14. The process of the present invention includes the first step of driving a first pile segment 16 into the earth 14 a desired distance from the structure 12. A second pile segment 18 is aligned onto the first pile segment 16 such that a conduit 20 in the second pile segment 18 is aligned with a conduit 22 in the first pile segment 16. The first pile segment 16 and the second pile segment 18 are driven into the earth 14 a desired distance from the structure 12. The strand 24 has an end 26 that is affixed into and through the conduits 22 and 20 of the respective first and second pile segments 16 and 18 so as to form a starter section. Another pile segment 28 slides along the strand 24 so as to reside upon the starter section. The respective pile segments 16, 18 and 28 are passed along the strand 24 through an area of clearance 30 formed in an excavated area 32 between the structure 12 and the earth 14.

In accordance with the teachings of the present invention, a third pile segment 34 can also be aligned with the second pile segment 18 such that the conduit 36 in the third pile segment 34 is axially aligned with the conduits 20 and 22 of the second pile segment and the first pile segment 16, respectively. In this embodiment, the first pile segment 16, the second pile segment 18 and the third pile segment 34 comprise the starter section. The first pile segment 16, the second pile segment 18 and the third pile segment 34 are then driven a desired distance from the structure 12. Also, a plurality of pile segments, such a pile segment 28 and pile segment 38 can be arranged in stacked relationship by being moved along strand 24 to a position in axial alignment with the starter section. It should be noted that the strand 24 can be suitably graduated so that the installer will know the depth of the stacked arrangement of pile segments.

Figure 8:
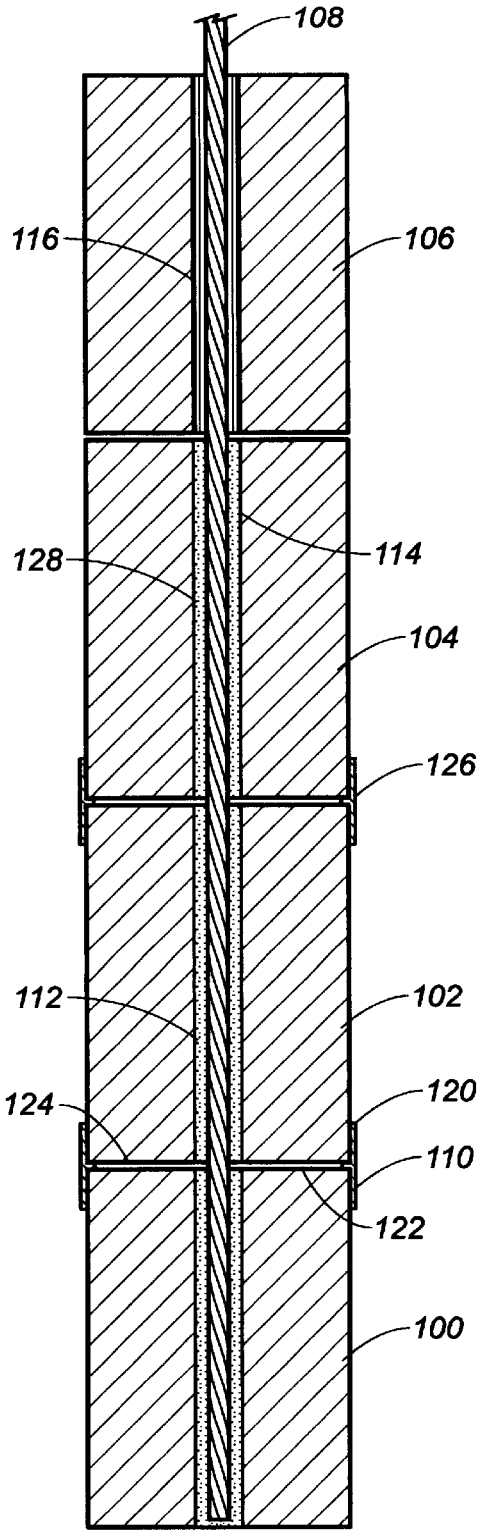
FIG. 8 shows an alternative process of installing pile segments using rings.

As can be seen in FIG. 1, each of the pile segments 16, 18, 34, 28 and 38 has a similar height. The size of each of these pile segments is configured so as to be easily manipulated by hand, along the strand 24 and through the area of clearance 30 between the earth 14 and the structure 12. Each of the pile segments has a weight suitable for hand manipulation. As such, the present invention allows for the installation of the various pile segments in an easy manner without the need for special equipment. The depth of pile penetration can be inspected by reading the strand marker at the point of installation or may be calculated by measuring the length of the strand remaining from the tip mark 35 and subtracting that length from the calibrated strand length. Each of the pile segments 16, 18, 34 28 and 38 has a generally elongated cubic configuration (as illustrated in FIG. 8). It has been found that the use of such a cubic pile segment has a superior structural integrity to that of a cylindrically shaped pile segment whenever such pile segments are made of concrete material.

In the precast concrete pile 10 as shown in FIG. 1, the end 26 of strand 24 is bonded within the conduits 22, 20 and 36 of the respective pile segments 16, 18 and 34 of the starter section. This bonding can be carried out with a cementing material such as epoxy. This stacked and aligned arrangement of pile segments 16, 18 and 34 provides a maximum area of adherence between the respective pile segments and the strand 24. As such, the process 10 of the present invention can provide high strand anchorage capacity. Since each of the pile segments 16, 18 and 34 are aligned for a considerable vertical distance, the strand 24 is more strongly urged into a proper vertical orientation. As such, the process 10 of the present invention is better able to maintain a straight pile during installation. By maintaining a straight pile during installation, the present invention avoids any buckling because of misalignment. The process 10 of the present invention also avoids the cost and labor requirements associated with manufacturing a single longer starter section.

Figure 2:
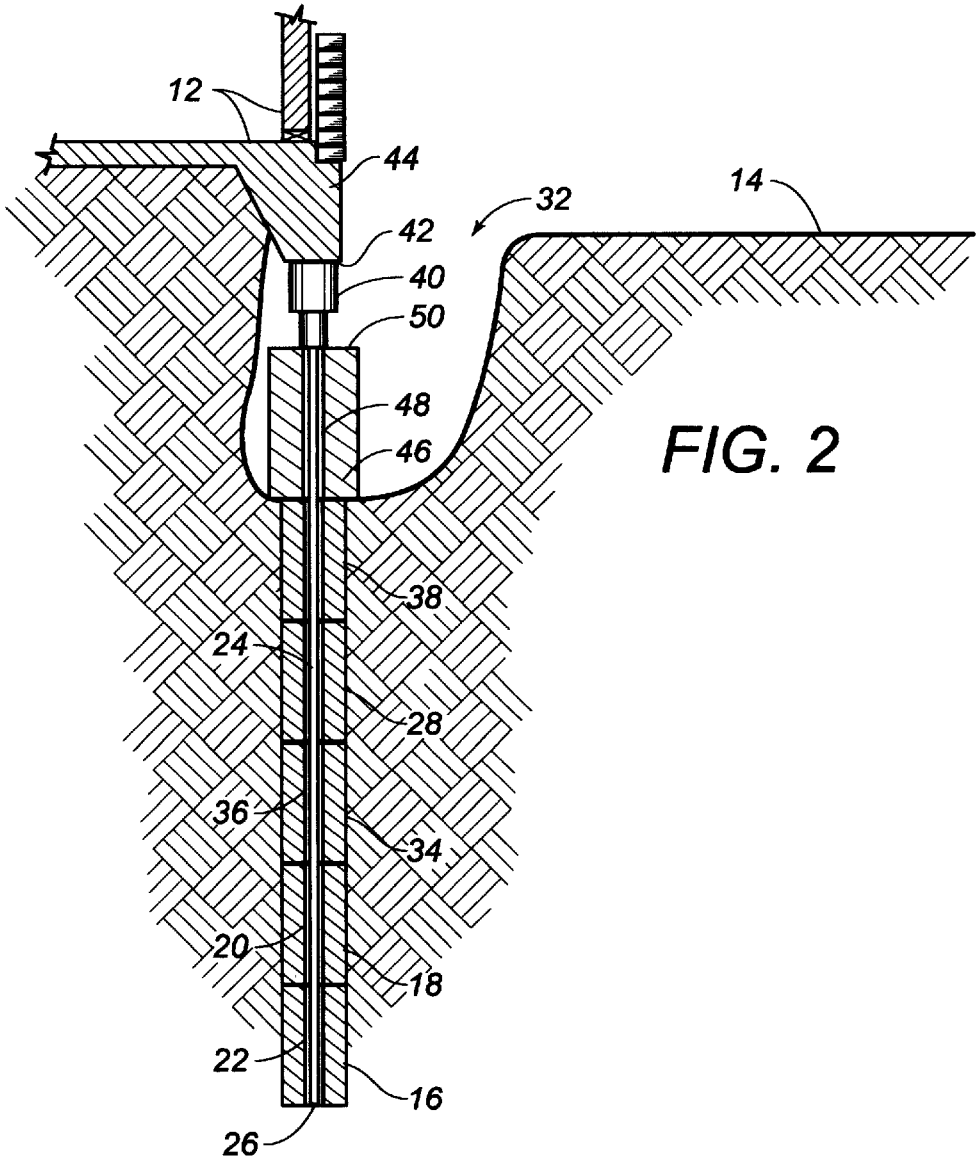
FIG. 2 is a partially cross-sectional view showing the completed installation of the pile segments in accordance with the teachings of the present invention.

FIG. 2 shows the assembled pile structure. In FIG. 2, it can be seen that hydraulic jack 40 is used to drive the various pile segments 16, 18, 34, 28 and 38 into the earth 14. In FIG. 2, it can be seen that the first pile segment 16 has been driven a desired distance into the earth 14 from the bottom 42 of the foundation 44 of the structure 12. The driving of the first pile segment 16 is accomplished by placing the second pile segment 18 onto the upper end of the first pile segment 16 and then using the hydraulic jack 40 to drive the pile segments 16 and 18 into the earth 14. In a sequential manner, the various other pile segments 34, 28 and 38 can be driven into the earth 14. As will be described hereinafter, the segments 16, 18 and 34 have internal conduits that are axially aligned. The end 26 of stand 24 is cemented within the conduits 22, 20 and 36 formed in the interior of the pile segments 16, 18 and 34. As such, the strand 24 will assure alignment of the various pile segments.

Ultimately, after the pile segments 16, 18, 34, 28 and 38 have been installed, a cap member 46 is installed on the uppermost end of the pile segment 38. The upper end 48 of the strand 24 is anchored in the cap member 46 adjacent the top 50 of the cap member 46. If necessary, the strand 24 can be suitably tensioned prior to being anchored in the cap member 46. The hydraulic jack 40 can then be removed so that the bottom 42 of the foundation 44 will reside on the top surface 50 of the cap member 46.

Figure 3:
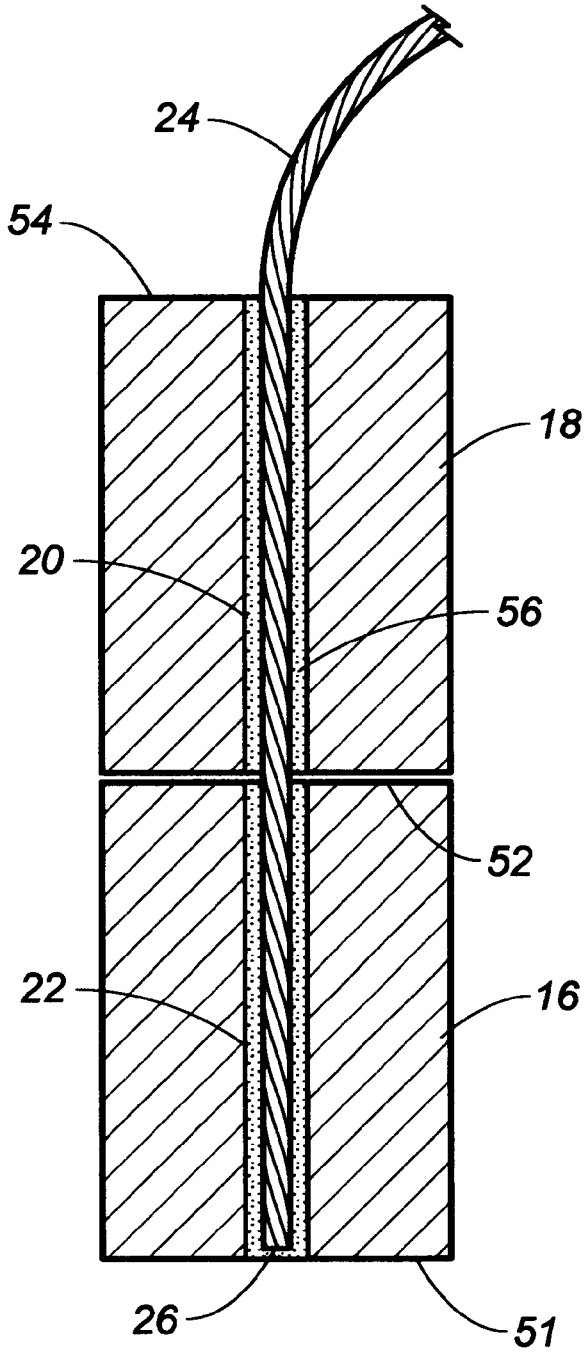
FIG. 3 is a detailed cross-sectional view showing the installation of the strand into the starter section.

FIG. 3 shows the installation of the strand 24 into the interior of the pile segments 16 and 18. In the present invention, as shown in FIG. 3, the third pile segment 34 has been omitted for the purpose of clarity. It is important to note that it is believed that the present invention can function properly if merely two pile segments, such as pile segments 16 and 18, are joined together.

In FIG. 3, it can be seen that the first pile segment 16 has a conduit 22 formed therein. The conduit 22 is a hole that extends vertically from the bottom 51 to the top 52 of the pile segment 16. The conduit 22 will have a diameter which is greater than that of the strand 24. The end 26 of strand 24 will reside adjacent to the bottom 51 of the first pile segment 16.

Similarly, the second pile segment 18 has a conduit 20 formed therein. Conduit 20 is shown as being in axial alignment with the conduit 22. Strand 24 has a portion which extends through the interior of conduit 20. For manufacturing simplicity, each of the pile segments 16 and 18 can have an identical configuration. The strand 24 will extend outwardly from the top 54 of the second pile segment 18. Additionally, so as to anchor the end 26 of strand 24 within the pile segments 16 and 18, a cementing material 56 is injected into the conduits 20 and 22 in the area between the exterior surface of the strand 24 and the wall of the conduits 20 and 22. As can be seen in FIG. 3, the stacked and adhered pile segments 16 and 18 will form the starter section. By aligning the pile segments 16 and 18 and then driving the pile segments into the earth, the end 26 of strand 24 can be inserted through the conduits 20 and 22 and then bonded within such conduits 20 and 22 so as to be properly anchored within such starter section.

The embodiment shown in FIG. 3 is carried out with the first pile segment 16 visually and manually aligned with the second pile segment 18. However, under certain circumstances, additional items may be necessary so as to assure proper alignment between the respective pile segments.

Figure 4:
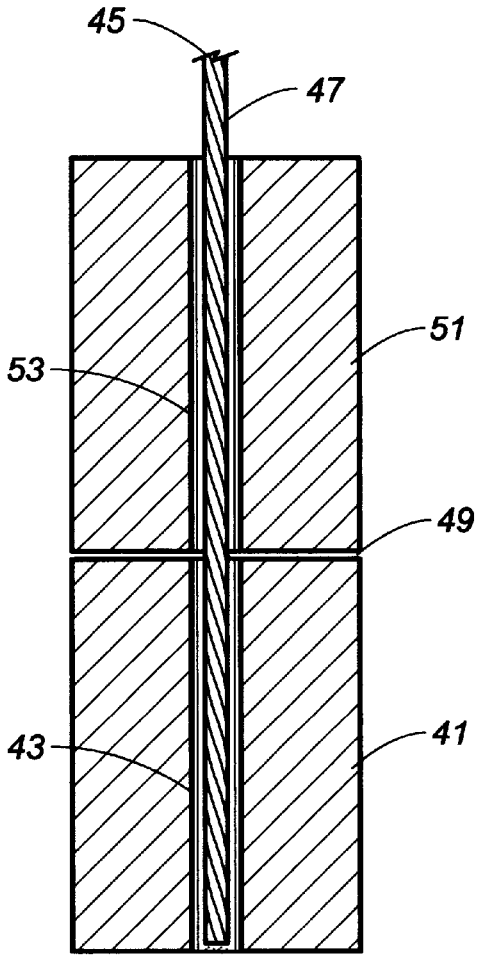
FIG. 4 is a cross-sectional view showing the method for aligning the pile segments in accordance with the preferred embodiment of the present invention.
Figure 5:
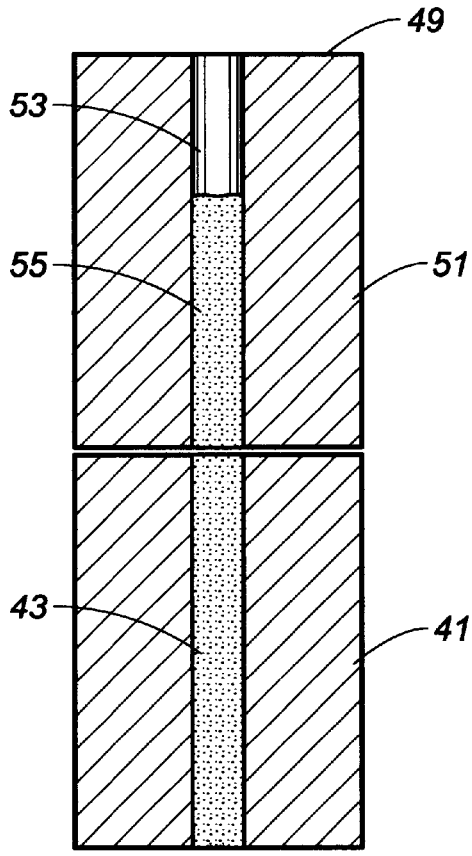
FIG. 5 shows the step of installing a cementing material in accordance with the preferred embodiment of the present invention.

In FIG. 4, it can be seen that a first pile segment 41 can be driven into the earth a desired distance from the structure. The first pile segment 41 has a conduit 43 formed therein. An alignment pin 45 is inserted into the conduit 43 of the first pile segment 41. The alignment pin 45 will have a portion which will extend above the top 49 of the first pile segment 41. A second pile segment 51 is then placed over the alignment pin 45. The second pile segment 51 has a conduit 53 extending therethrough. The alignment pin 45 assures that the conduit 43 of first pile segment 41 is aligned with the conduit 53 of the second pile segment 51. The alignment pin 45 can be a rebar segment of an appropriate length. The first pile segment 41 and the second pile segment 51 can be driven a desired distance into the earth from the structure. The alignment pin 45 will have a portion 47 extending outwardly of the top of the second pile segment 51. This outwardly extending portion 47 can be grasped by a worker and then removed from the conduits 43 and 53. With reference to FIG. 5, a suitable cementing material 55 can be inserted into the conduits 43 and 53 into the space vacated by the alignment pin 45. A strand can then be inserted into the conduits 43 and 53 such that the end of the strand is rigidly affixed within the starter section defined by the first pile segment 41 and the second pile segment 51. The alignment pin 45, since it was removed prior to the cementing operation, can be reused in other installations. Still further, it should be noted that it is possible that the first pile segment 41 and the second pile segment 51 can be driven into the earth following the removal of the alignment pin 45.

Figure 6:
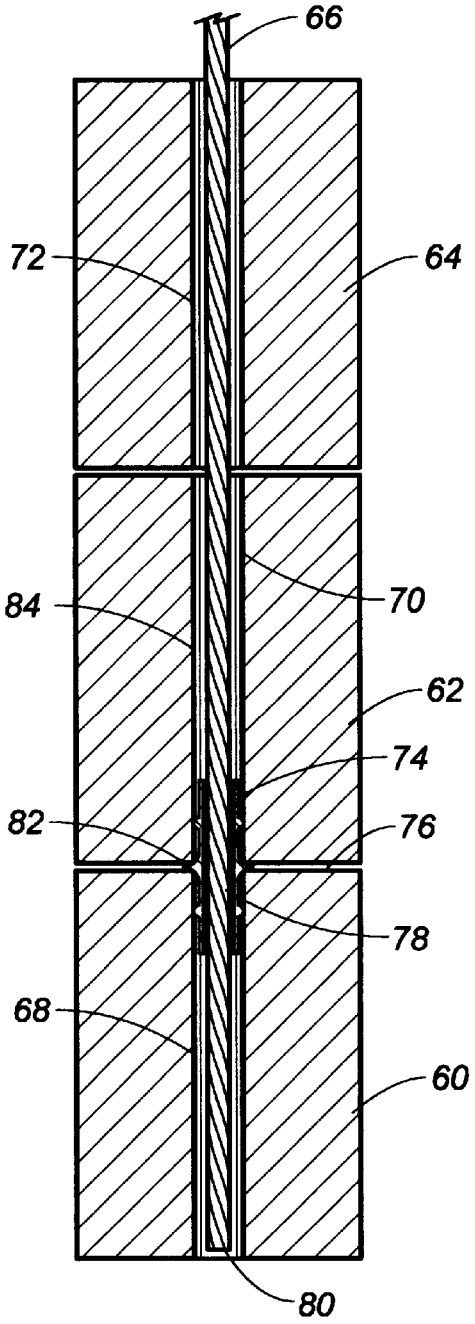
FIG. 6 is a cross-sectional view showing the strand as installed within pile segments in accordance with an alternative embodiment of the present invention.

FIG. 6 shows an alternative form of the present invention. In FIG. 4, it can be seen that there is a first pile segment 60, a second pile segment 62 and third pile segment 64 in stacked and aligned relationship. Strand 66 is anchored into the conduits 68 and 70 of respective pile segments 60 and 62. The strand 66 extends through the conduit 72 of pile segment 64.

So as to allow for the proper alignment of the second pile segment 62 upon the first pile segment 60, a tubular member 74 is initially inserted into the conduit 68 of the first pile segment 60. The second pile segment 62 can then be placed onto the top 76 of the first pile segment 60 so that the tubular member 74 will have a portion 78 extending into the conduit 70. As such, axial alignment of the conduit 68 and 70 is assured. The tubular member 74 will have an interior diameter greater than the outer diameter of the strand 66. The upper edge of the tubular member 74 is suitably feathered so as to guide the end 80 of strand 66 therethrough. A positioning ridge 82 extends outwardly radially from the tubular member 74 so as to rest upon the top 76 of the first pile segment 60 and to be interposed between the bottom of the second pile segment 62 and the top 76 of the first pile segment 60. The positioning ridge 82 will assure that the tubular member 74 will reside in its desired position. The tubular member 74 can be formed so as to be suitably porous so that the cementing material 84 can flow through the conduits 68 and 70 and into the area between the first pile segment 60 and the second pile segment 62, if desired.

Figure 7:
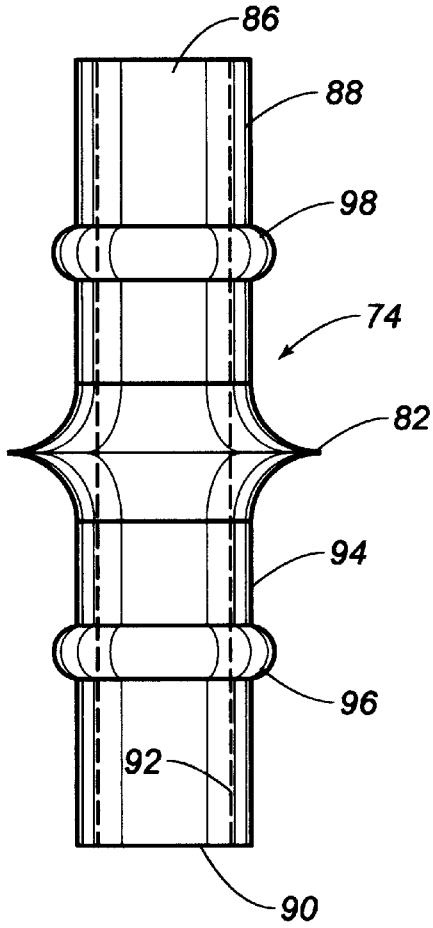
FIG. 7 is a side elevational view of the tubular member as used in the installation method of FIG. 6.

FIG. 7 is a detailed view of the tubular member 74. It can be seen that the tubular member 74 includes an interior passageway 86 through which the strand 66 will pass. The feathered end 88 is illustrated in broken line fashion in FIG. 7. The bottom 90 of the tubular member 74 can also have a feathered edge 92 so that a proper positioning of the tubular member 74 can be assured. The positioning ridge 82 extends outwardly from the outer wall 94 of the tubular member 74. Engagement sections 96 and 98 extend slightly outwardly of the outer wall 94 so as to provide for more secure engagement with the walls of the respective conduits 68 and 70.

FIG. 8 shows an alternative form of the present invention having a first pile segment 100, a second pile segment 102 and third pile segment 104. Pile segments 100, 102 and 104 form the starter section of the process of the present invention. A fourth pile segment 106 is positioned on the top of pile segment 104. Strand 108 will extend through the respective conduits 110, 112, 114 and 116 of respective pile segments 100, 102, 104 and 106.

So as to assure alignment between the pile segments 100 and 102, a ring member 118 is positioned around the pile segment 100 so as to have an upper portion 120 which extends above the top surface 122 of pile segment 100. The second pile segment 102 can then be placed on the interior of the ring member 118 within portion 120. In this manner, alignment of the conduits 110 and 112 is assured. A positioning ridge 124 extends inwardly so as to rest upon the top surface 122 of the first pile segment 100 and between the first pile segment 100 and the second pile segment 102. Another ring member 126 can be placed, in a similar manner, between pile segments 102 and 104. In this embodiment, it can be seen that the cementing material 128 will flow in the area between the outer surface of the strand 108 and the wall of the conduits 110, 112 and 114. Additionally, the cementing material 128 can flow into any spaces that may exist between the top surface 122 of the first pile segment 100 and the bottom surface of the second pile segment 102. This cementing material 128 can also flow in the area between the top of pile segment 102 and the bottom of pile segment 104.

Figure 9:
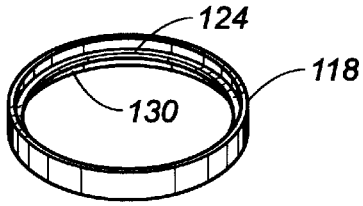
FIG. 9 is a perspective view showing a ring as used in the process shown in FIG. 8.

FIG. 9 shows a perspective view of ring member 118. As can be seen, the positioning ridge 124 extends radially inwardly from the inner wall 130 of the ring member 118.

Figure 10:
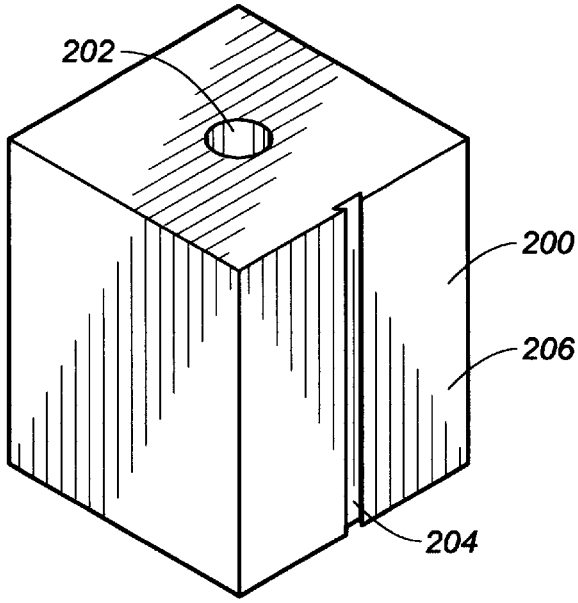
FIG. 10 is an upper perspective view of a single pile segment as used in the present invention.

FIG. 10 is a perspective view of a single pile segment 200 as used in the preferred embodiment of the present invention. The pile segment 200 is of an elongated cubic configuration a greater height than the width). Conduit 202 extends centrally through the interior of pile segment 200. A groove 204 can be formed on a side 206 of pile segment 200. The groove 204 is suitable for the receipt of an alignment pin therein. The elongated cubic configuration of the pile segment 200 is preferred for manufacturing reasons. The structural integrity of such elongated cubic pile segment 200 is better than a cylindrically shaped pile segment when formed of a concrete material.

Figure 11:
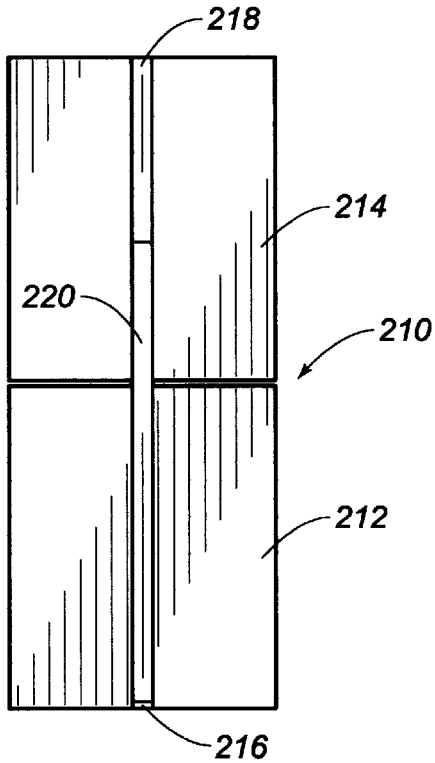
FIG. 11 is a side view of the pile segments as aligned through the use of an alignment key.

FIG. 11 shows a starter section 210 as formed of pile segments 212 and 214. The groove 216 of pile segment 212 is aligned with the groove 218 of pile segment 214 through the use of an alignment pin 220. The alignment pin 220 is not removed following the installation of pile segments 212 and 214. The alignment pin 220 is used to keep the square-shaped pile segments from spinning or misaligning as they are being driven into the earth. Alignment pins, such as alignment pin 220, can be installed sequentially in end-to-end relationship in the grooves of pile segments as they are installed in the earth so as to form the supporting pile below the structure. Another alignment pin or rebar can be used in and removed from the respective conduits 202 of such pile segments in the manner described earlier herein.

It is contemplated that various techniques could be used so as to assure alignment between the pile segments of the starter section other than those described hereinbefore. Various items, such as grooves, key ways, mating elements and alignment tools can be used so as to assure that the conduits are axially aligned.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A process for installing piles for supporting a structure upon the earth comprising:

driving a first pile segment into the earth a first desired distance from the structure, said first pile segment having a conduit therein;

aligning a second pile segment upon said first pile segment such that a conduit in said second pile segment is axially aligned with said conduit of said first pile segment;

driving said first and second pile segments into the earth a second desired distance from the structure;

affixing a strand into said conduits of said first and second pile segments subsequent to said step of driving so as to form a starter section; and sliding another pile segment along said strand so as to reside upon said starter section.

2. The process of claim 1, further comprising:

aligning a third pile segment upon said second pile segment prior to said step of affixing a strand such that said conduit of said third pile segment is axially aligned with the conduits of said first and second pile segments, said starter section further comprising said third pile segment.

3. The process of claim 2, further comprising:

driving said first pile segment and said second pile segment and said third pile segment prior to said step of affixing a strand into the earth a third desired distance from said structure.

4. The process of claim 1, said conduit of said first pile segment being a hole extending vertically through said first pile segment, said conduit of said second pile segment being a hole extending vertically through said second pile segment.

5. The process of claim 1, said step of aligning comprising:

inserting an alignment pin into said conduit of said first pile segment such that a portion of said alignment pin extends outwardly of a top of said first pile segment; and placing said conduit of said second pile segment over said alignment pin.

6. The process of claim 5, further comprising:

removing said alignment pin from said conduits of said first and second pile segments prior to said step of affixing.

7. The process of claim 1, said step of affixing said strand comprising:

bonding said strand within said conduits of said first and second pile segments.

8. The process of claim 7, said step of bonding comprising:

injecting a cementing material in a space between an outer surface of said strand and respective walls of said conduits of said first and second pile segments.

9. The process of claim 1, said step of affixing a strand comprising:

sliding said strand through said conduits of said first and second pile segments until an end of said strand is adjacent a bottom of said first pile segment.

10. The process of claim 1, said step of sliding another pile segment comprising:

sliding a plurality of pile segments along said strand so as to reside in stacked relationship upon said starter section, said strand extending through aligned conduits formed in said plurality of pile segments.

11. The process of claim 10, further comprising:

positioning a cap member between a portion of the structure and an uppermost pile segment of said plurality of pile segments; and anchoring an end of said strand in said cap member.

12. The process of claim 11, further comprising:

tensioning said strand prior to the step of anchoring.

13. The process of claim 1, further comprising:

removing a volume of earth from beneath a portion of the structure; and positioning said first pile segment directly below said portion of said structure.

14. A process of installing piles for supporting a structure upon the earth comprising:

driving a first pile segment into the earth a first desired distance from the structure, said first pile segment having a conduit therein;

installing a rigid member on or into said first pile segment so as to have a portion extending outwardly of a top of said first pile segment;

placing a second pile segment around said portion of said rigid member such that said conduit of said first pile segment is axially-aligned with a conduit of said second pile segment;

driving said first and second pile segments into the earth a second desired distance from the structure;

removing said rigid member from said conduits of said first and second pile segments;

affixing a strand into said conduits of said first and second pile segments subsequent to said step of driving said first and second pile segments so as to form a starter section; and sliding another pile segment along said strand so as to reside upon said starter section.

15. The process of claim 14, said rigid member comprising an alignment pin, said step of installing comprising:

inserting said alignment pin into said conduit of said first pile segment so as to have said portion extending outwardly of said top of said first pile segment; and placing said conduit of said second pile segment over said portion of said alignment pin such that a bottom of said second pile segment resides adjacent to said top of said first pile segment.

16. The process of claim 14, said step of affixing comprising:

injecting a cementing material into a space between an outer surface of said strand and respective walls of said conduits of said first and second pile segments.

17. The process of claim 14, said step of sliding another pile segment comprising:

sliding a plurality of pile segments along said strand so as to reside in stacked relationship upon said starter section, said strand extending through aligned conduits formed in said plurality of pile segments.

18. The process of claim 17, further comprising:

positioning a cap member between a portion of the structure at an uppermost pile segment of said plurality of pile segments; and anchoring an end of said strand in said cap member.

* * * * *